US008290171B1

(12) United States Patent
Helfrich et al.

(10) Patent No.: US 8,290,171 B1
(45) Date of Patent: Oct. 16, 2012

(54) HEADSET WITH MICROPHONE AND WIRED REMOTE CONTROL

(75) Inventors: Kenneth Jay Helfrich, Duluth, GA (US); Larry D. Barnes, Raleigh, NC (US)

(73) Assignee: Maxim Integrated Products, Inc., San Jose, CA (US)

( * ) Notice: Subject to any disclaimer, the term of this patent is extended or adjusted under 35 U.S.C. 154(b) by 509 days.

(21) Appl. No.: 12/545,021

(22) Filed: Aug. 20, 2009

(51) Int. Cl.
*H04R 1/10* (2006.01)

(52) U.S. Cl. ..... 381/74; 381/111; 381/122

(58) Field of Classification Search ..... 381/111, 381/112, 113, 114, 115, 122, 123, 74, 92; 324/609, 120, 76.11; 710/69, 72, 36; 74/512; 701/36; 455/226.4
See application file for complete search history.

(56) References Cited

U.S. PATENT DOCUMENTS 5,862,493 A * 1/1999 Barkat et al. ..... 455/572
6,262,567 B1 * 7/2001 Bartlett ..... 323/303
2003/0174524 A1 * 9/2003 Botker et al. ..... 363/60
2009/0179789 A1 7/2009 Haughay et al.
2009/0182913 A1 7/2009 Rosenblatt et al.

OTHER PUBLICATIONS

Texas Instrument, "200mA Low-Dropout Linear Regulator with Pin-Selectable Dual-Voltage Level Output", Texas Instrument, Document SBVS095, pp. 1-13, Aug. 2007.*

* cited by examiner

*Primary Examiner* — Vivian Chin
*Assistant Examiner* — Leshui Zhang
(74) *Attorney, Agent, or Firm* — TIPS Group

(57) ABSTRACT

In an example embodiment a headset includes a phone jack, a speaker connected to the phone jack, a microphone coupled to the phone jack and a resistive switch string coupled to the phone jack to the same ring of the phone jack as the microphone. In another example an integrated circuit device includes a charge pump, a multi-voltage LDO having an input which is capable of being coupled to an output of the charge pump, an ADC; and a pull-up resistor coupled between an output of the LDO and an input of the ADC. In another example embodiment, a method for headset signal multiplexing includes providing a headset with a plurality of signal sources and voltage division multiplexing the plurality of signal sources on a common wire.

5 Claims, 10 Drawing Sheets

HEADSET WITH MICROPHONE AND WIRED REMOTE CONTROL

BACKGROUND

Example embodiments disclosed herein pertain to headsets. More particularly, example embodiments disclosed herein pertain to acoustic headsets with additional functionality.

There are several common headset types. For example, a "mono voice" headset includes one speaker and one microphone. A "stereo audio" headset includes two speakers only. i.e. it is a standard set of stereo headphones. A "stereo voice" headset includes two speakers and a microphone. A "stereo remote" headset includes two speakers and a multi-button remote. An example of a stereo remote headset is the headset provided with the Apple iPod Shuffle. A "voice only" headset includes a microphone but no speakers.

Many electronic devices use phone jacks for audio connectivity. For example, many cell phones and MP3 players use either a 2.5 mm or a 3.5 mm phone jack for such purposes. A headset includes a complementary phone plug to connect to the electronic device. Phone plugs are also referred to as TRS connectors (tip, ring, sleeve). They are usually cylindrical in shape, typically with three contacts ("rings"), although sometimes with two rings (a TS connector) or four rings (a TRRS connector).

The most common connectors used with multifunction headsets are the 3-ring TRS connectors and the 4-ring TRRS connectors. With the TRS connectors, a 2.5 mm version is used primarily for mono voice and a 3.5 version is used primarily for stereo audio. With the TRRS connectors (both 2.5 mm and 3.5 mm), the fourth ring can be used for one of a mono microphone, wired remote control, or composite video.

FIG. 1 is a schematic diagram of a prior art stereo voice headset. The headset 10 includes a phone plug 12, stereo speakers 14 and 16, a microphone 18 and a high-frequency shunt or "bypass" capacitor 20. Alternatively, an internal bypass capacitor may be integrated with the microphone 18 in which case an external bypass capacitor 20 is not needed. This headset uses a TRRS connector with two rings being used, one each, for stereo speakers, one for ground, and one for a microphone. The rings of all of these connector types are typically made from an electrically conductive metal and are electrically insulated from each other.

FIG. 2 is a schematic diagram of a prior art stereo voice headset 10' with microphone. The headset 10' is essentially the same as the headset 10, with the addition of a send/end switch ("button") 22. In the prior art, the send/end button either shorts across a microphone or is put in series with a microphone to selectively disable the microphone.

FIG. 3 is a schematic diagram of a prior art stereo remote headset. The headset 24 includes the phone plug 12, stereo speakers 14 and 16, and send/end button 22 of headset 10' of FIG. 2. However, the microphone 18 has been replaced with a wired remote control 26 comprising a number of resistors that can be coupled to ground by switches ("buttons"). Since the resistors of the remote control 26 have different values, pressing different buttons can create distinct voltage drops which can be detected by circuitry, not shown, which is connected to the fourth ring "RMT" of the phone plug 12.

A problem encountered in the prior art is that only so much functionality can be supported by a phone plug. In stereo applications two of the rings are used for the left and right speakers of a headset, while a third ring is coupled to ground. This leaves only the fourth ring to support any other functionality of the headset such as a microphone or wired remote control. As a result, prior art stereo headsets were typically limited to one other function, such as a microphone as shown in FIGS. 1 and 2, or a wired remote control as shown in FIG. 3.

These and other limitations of the prior art will become apparent to those of skill in the art upon a reading of the following descriptions and a study of the several figures of the drawing.

SUMMARY

In an embodiment, set forth by way of example and not limitation, a headset includes a phone jack having at least three electrically conductive rings, a speaker having a first node electrically coupled to a speaker ring of the phone jack, a conductor electrically coupling a ground ring of the phone jack to ground; a microphone having a first node electrically coupled to a microphone/remote ring of the phone jack; and a resistive switch string having a first node electrically coupled to the microphone/remote ring of the phone jack. In this example embodiment, the headset includes both microphone and remote control features on a single ring of a phone jack.

In an embodiment, set forth by way of example and not limitation, an integrated circuit device includes a charge pump, a multi-voltage LDO having an input which is capable of being coupled to an output of the charge pump, an ADC; and a pull-up resistor coupled between an output of the LDO and an input of the ADC. In this example embodiment, an integrated circuit device capable of being used in, for example, a portable electronic device, supports existing and new headset designs having multifunction capabilities.

In an embodiment, a method for headset signal multiplexing including providing a headset with a plurality of signal sources and voltage division multiplexing the plurality of signal sources on a common wire. In an embodiment, one of the plurality of signal sources is a microphone and another of the plurality signal sources is a resistive switch string.

An advantage of certain example embodiments is that providing multiple control buttons in a headset is increasingly desirable for small, portable, multi-function electronic devices.

An advantage of certain example embodiments is that the portions of the circuitry which are not in the headset are backwardly compatible with prior headsets that do not include multiple button functionality.

These and other embodiments and advantages and other features disclosed herein will become apparent to those of skill in the art upon a reading of the following descriptions and a study of the several figures of the drawing.

BRIEF DESCRIPTION OF THE DRAWINGS

Several example embodiments will now be described with reference to the drawings, wherein like components are provided with like reference numerals. The example embodiments are intended to illustrate, but not to limit, the invention. The drawings include the following figures.

DETAILED DESCRIPTION OF EXAMPLE EMBODIMENTS

Figure 1:
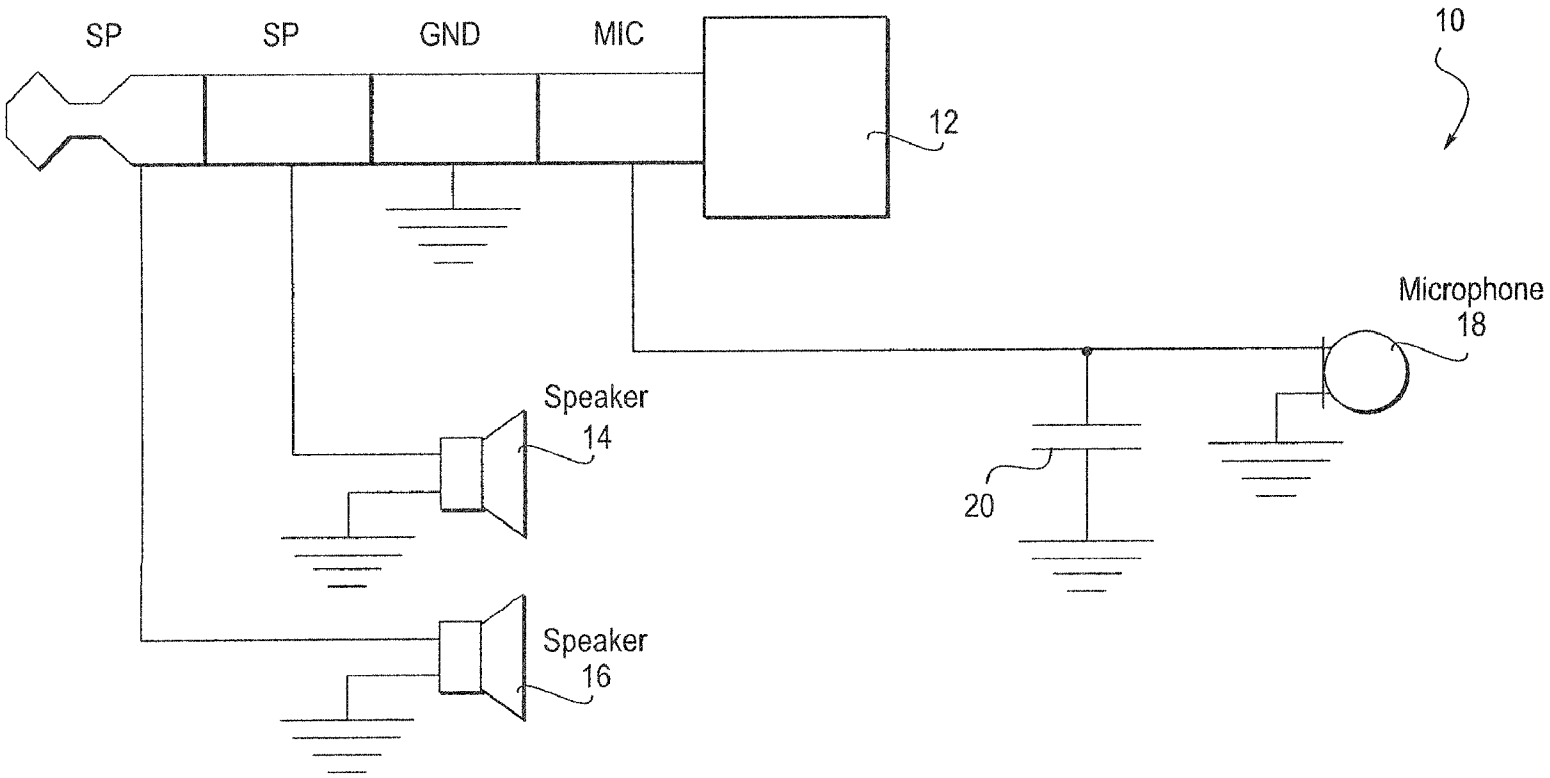
FIG. 1 (PRIOR ART)
FIG. 1 is a schematic diagram of a prior art headset with microphone.
Figure 2:
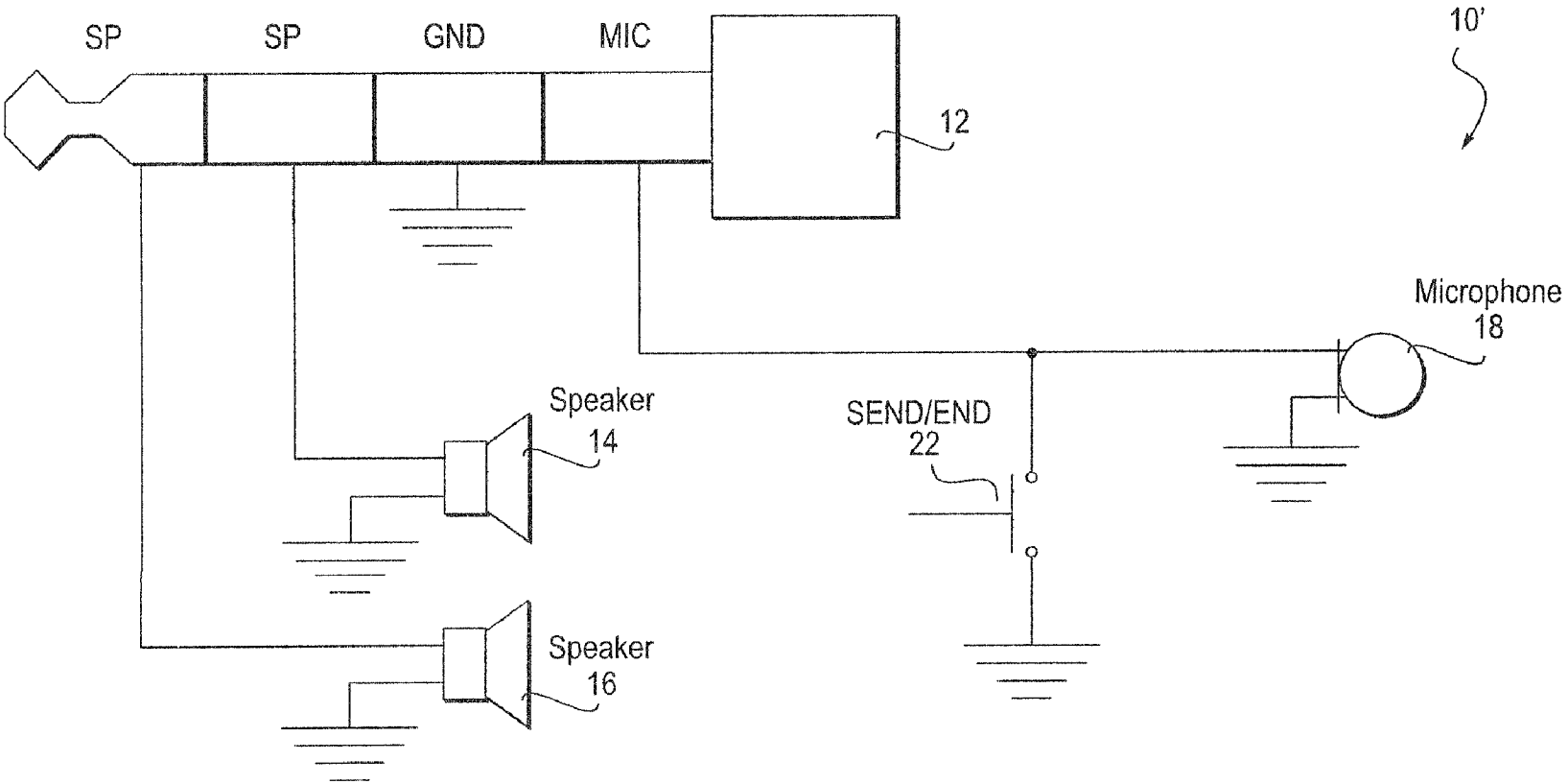
FIG. 2 (PRIOR ART)
FIG. 2 is a schematic diagram of a prior art headset with microphone and send/end button.
Figure 3:
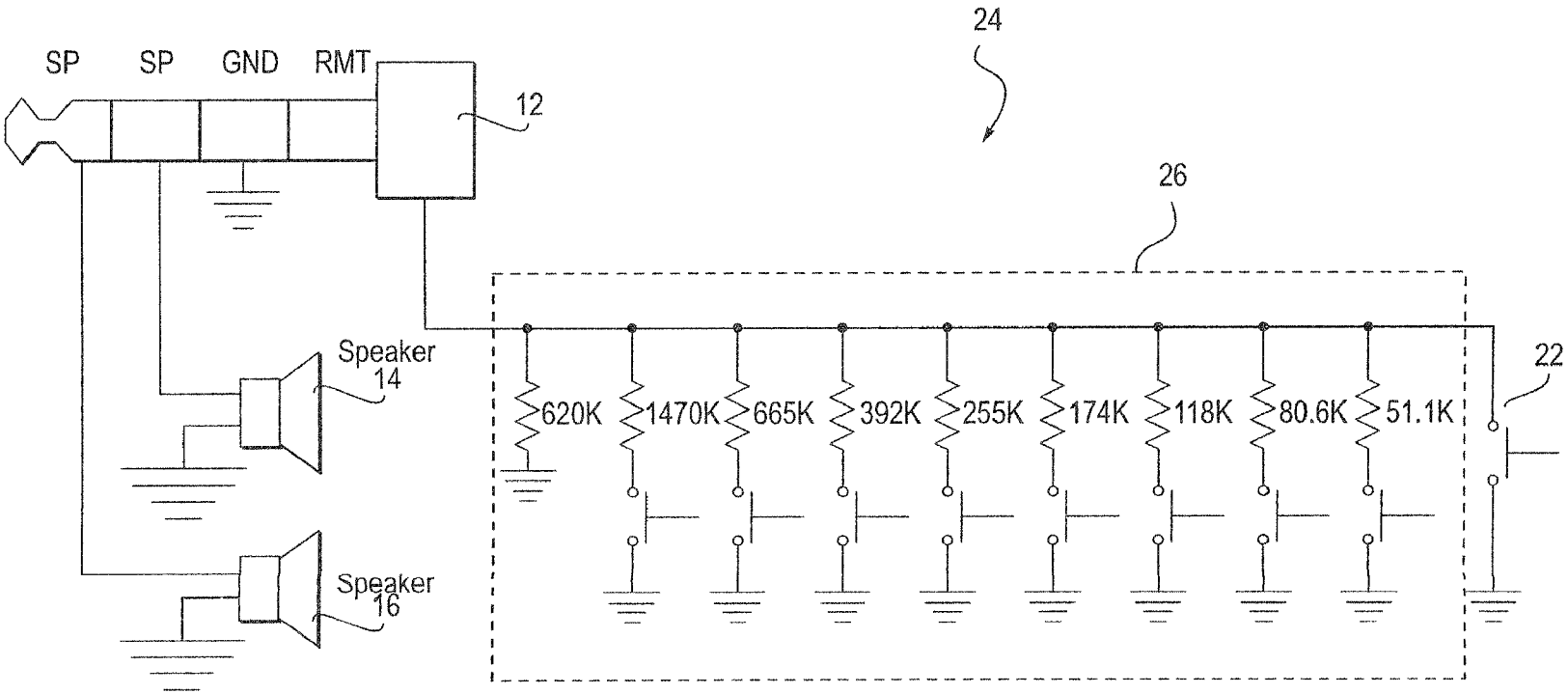
FIG. 3 (PRIOR ART)
FIG. 3 is a schematic diagram of a prior art headset with wired remote control.
Figure 4:
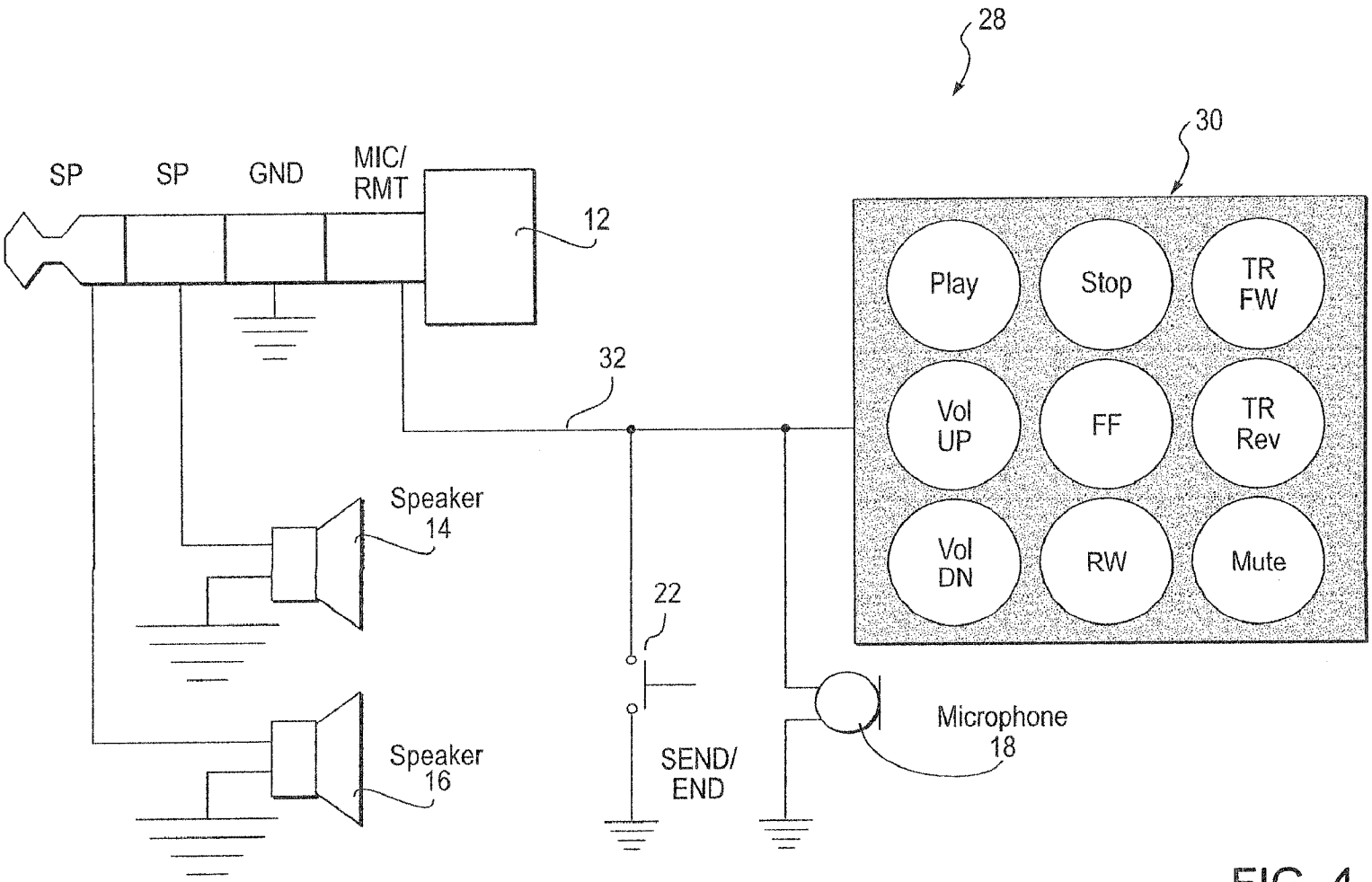
FIG. 4 is a schematic/block diagram of a first example embodiment of a headset with microphone, send/end button and wired remote control.

FIGS. 1-3 were described with respect to the prior art. FIG. 4 is a schematic diagram of an embodiment for a headset with microphone and wired remote control. The embodiment of FIG. 4 is set forth by way of example and not limitation.

In FIG. 4, a headset 28 includes a phone jack 12, a pair of stereo speakers 14 and 16, and a send/end button 22 as described with respect to the prior art. However, in this example embodiment, the headset 28 includes both a microphone 18 and a keypad 30 ("wired remote control"). In this embodiment, first and second rings "SP" of phone jack 12 are connected to speakers 14 and 16, respectively, and a third ring "GND" is connected to ground. The send/end button 22, the microphone 18 and the keypad 30 are all coupled to a common conductor 32 connected, for example, to the fourth ring ("MIC/RMT") of the phone plug 12.

As is well known to those of skill in the art, microphones, such as microphone 18, can be of various types. For example, microphones can operate by electromagnetic induction (dynamic microphone), capacitance change (condenser microphone), piezoelectric generation, or light modulation to produce the signal from mechanical vibration. One type of condenser microphone is the electret microphone. A typical electret microphone has a preamp circuit uses an FET (or "JFET") in a common source configuration which is externally powered by supply voltage Vcc.

Figure 5:
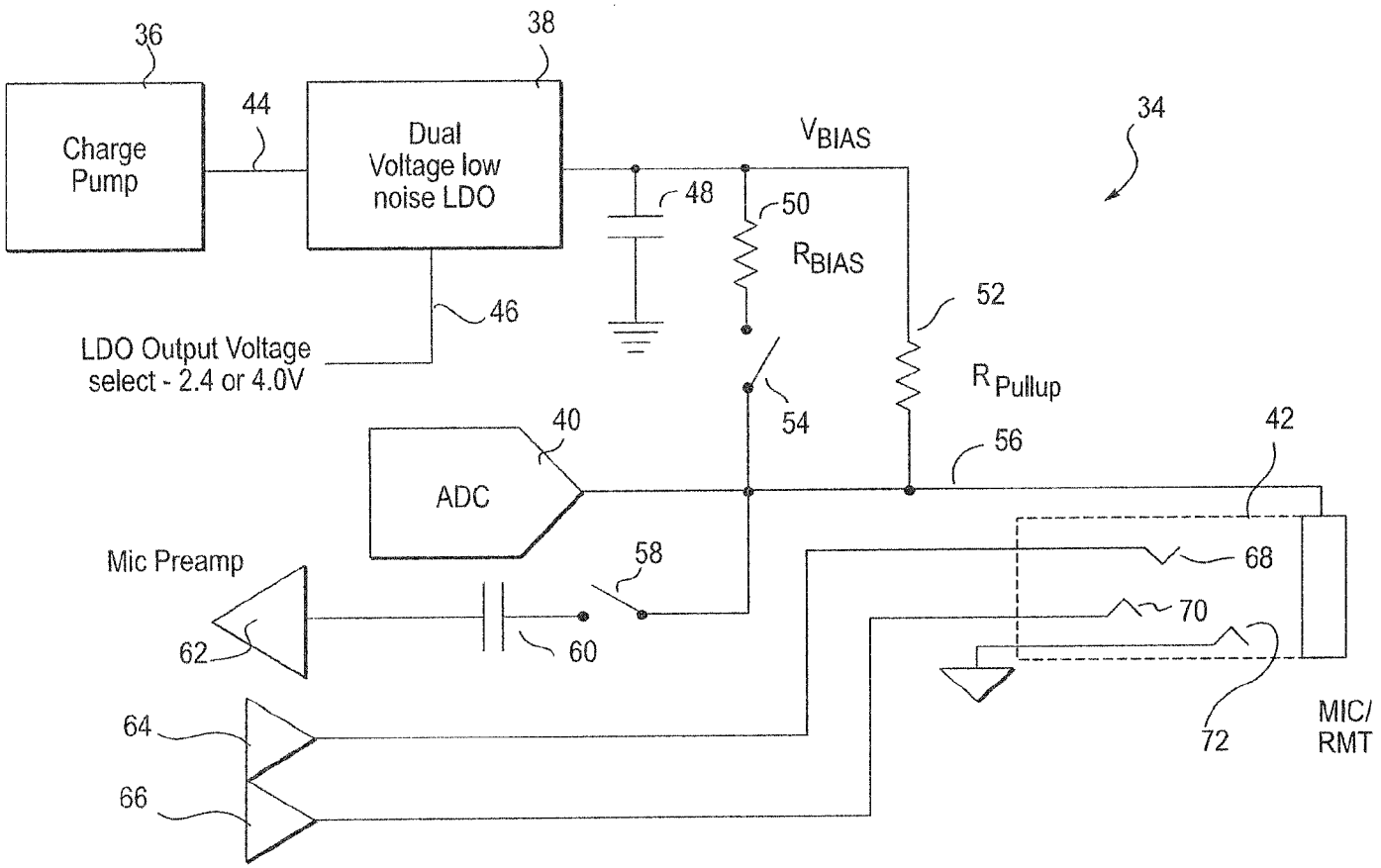
FIG. 5 is a schematic/block diagram of first example circuitry useful with the example headsets of FIGS. 4, 6 and 8.

In FIG. 5, example circuitry 34 useful with various example headsets as described herein, is illustrated with a schematic/block diagram. The example circuitry 34 may be found in a variety of electronic devices, including, without limitation, the aforementioned MP3 players and cell phones. The example circuitry 34 includes a charge pump 36, a dual-voltage low drop out regulator ("LDO") 38, an analog-to-digital converter ("ADC") 40, and a phone jack 42. The charge pump 36 is coupled to the LDO 38 by a line 44. The output voltage $V_{BIAS}$ of the LDO 38 is controlled by a control line 46. By way of non-limiting example, $V_{BIAS}$ may be selected to be 2.4 volts or 4.0 volts. Other voltage levels can also be used, as will be appreciated by those of skill in the art.

An output of the LDO 38, in this example embodiment, is coupled to a lead of a capacitor 48, a resistor $R_{BIAS}$ 50 and a resistor $R_{Pullup}$ 52. The other lead of capacitor 48 is coupled to ground. The other lead of resistor $R_{BIAS}$ 50 is coupled by a switch 54 to a line 56 which couples the MIC/RMT ring of jack 42 to an input of the ADC 40. A second lead of resistor $R_{Pullup}$ 52 is also coupled to the line 56. A series connection of a switch 58 and capacitor 60 couples line 56 to a microphone preamp node 62. Stereo "audio out" nodes 64 and 66 are coupled to contacts 68 and 70 of the phone jack 42, and a contact 72 of phone jack 42 is coupled to ground.

As will be appreciated by those of skill in the art, a charge pump, such as charge pump 36, is a form of D.C. to D.C. converter that uses capacitors as energy storage elements to create either a higher or lower voltage power source. In this case, charge pump 36 is used to create a higher voltage. To generate a higher voltage, a first stage of charge pump 36 connects a capacitor across a voltage to hold a charge. In a second stage, the capacitor is disconnected from the original charging voltage and reconnected with its negative terminal to the original positive charging voltage. Because a capacitor retains its charge, its voltage is added to the original, effectively doubling the original voltage. The pulsing nature of the higher voltage output is typically smoothed by the use of an output capacitor.

A low-dropout or "LDO" regulator, such as LDO 38, is a D.C. linear voltage regulator which can operate with a very small input-output differential voltage. The main components are a power FET and a differential or "error" amplifier. One input of the differential amplifier monitors a percentage of the output, as determined by a resistor ratio. Another input to the differential amplifier is from a stable voltage reference. If the output voltage rises too high relative to the reference voltage, the drive to the power FET changes so as to maintain a constant output voltage.

An analog-to-digital converter or "ADC", such as ADC 40, is a device which converts continuous analog signals to discrete digital numbers. Typically, an ADC is an electronic device that converts an input analog voltage (or current) to a digital number proportional to the magnitude of the voltage or current. The digital output may use different coding schemes, such as binary, Gray code or two's complement binary.

Figure 6:
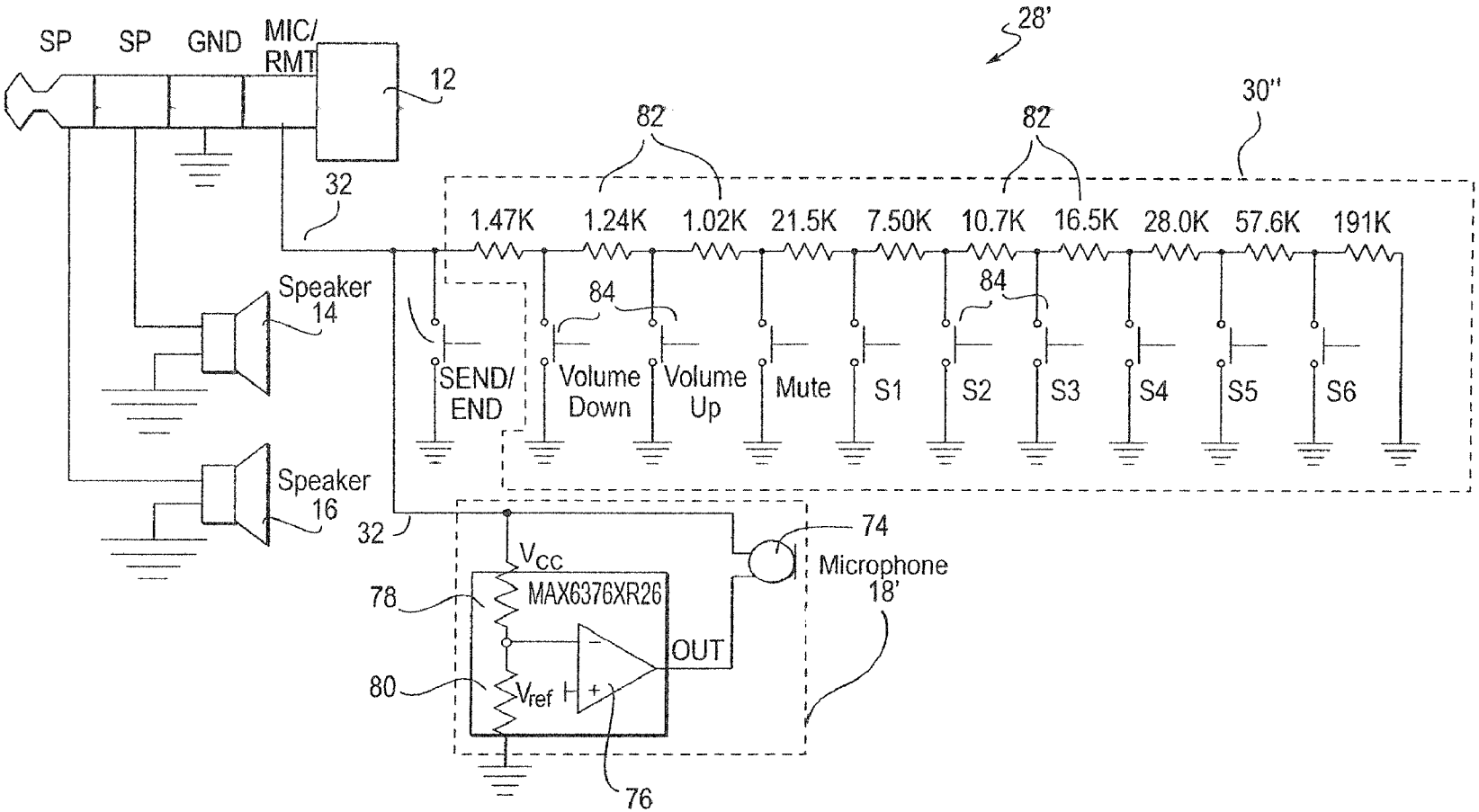
FIG. 6 is a schematic diagram of a second example embodiment of a headset with microphone, send/end button and wired remote control.

In FIG. 6, an alternative embodiment headset 28' is substantially the same as the previously described headset 28 of FIG. 4 with the exception of an example active microphone circuit 18' and example circuitry for a keypad ("resistive switch string") 30'. It will be appreciated by those of skill in the art that these circuits are by way of example and not limitation, and other circuit designs can be implemented for similar purposes.

The active microphone circuit 18' includes a microphone 74, a differential voltage detector 76, and two resistors 78 and 80 connected in series between a line 32 and ground. The voltage detector can be, for example, a MAX6376XR26 voltage detector available from Maxim Integrated Products of Sunnyvale, Calif. The node between resistors 78 and 80 (a "resistor pair") is coupled, in this example, to the negative input of voltage detector 76, and the positive input of voltage detector 76 is coupled to $V_{ref}$. The microphone 74 is coupled between line 32 and the output of voltage detector 76.

In this example embodiment, the resistive switch string 30' includes a number of resistors 82 and a number of switches or "buttons" 84. The resistors 82 are often of different values as indicated in this example, although this is not always the case. The buttons 84 are often normally open, momentary SPST (single pole, single throw) switches. In this embodiment, the buttons 84 selectively couple nodes between a string ("series connection") of resistors 82. The design of resistive switch strings are well known to those of skill in the art.

In operation, the phone plug 12 of headset 28' in FIG. 6 of can be plugged into, for example, the phone jack 42 of the circuitry 34 in FIG. 5, thereby creating electrical connections between the headset 28' and the circuitry 34 as will be appreciated by those of skill in the art. For example, the contacts 68 and 70 of the phone jack 42 make an electrical connection with the two SP rings of the phone plug 12, the contact 72 of the phone jack 42 makes an electrical connection with the GND ring of jack 12, and the MIC/RMT contact of phone jack 42 makes and electrical connection with the MIC/RMT ring of the phone plug 12. The circuitries of FIGS. 5 and 6 are therefore electrically connected together by plugging the phone plug 12 into the phone jack 42.

Connecting the circuitries of FIGS. 5 and 6 together create an operational headset circuit having multiple signal sources, e.g. microphone 74 and keypad 30', in an example embodiment. The first example circuitry 34 of FIG. 5 is typically inside of an electronic device (e.g. cell phone, MP3 player, portable computer, PDA, etc.). The circuitry 28' of FIG. 6 is typically enclosed within the headset. It should be noted in this example embodiment that there is only one active device within the headset, i.e. the voltage detector 76.

The combined circuit of FIGS. 5 and 6, in this example, operate as a voltage division multiplexed circuit allowing a plurality (i.e. two or more) of signal sources to be carried by a single ("common") wire. That is, by "voltage division multiplexed" it is meant herein that a plurality of signals are applied to a common conductor by offsetting the plurality of signals by D.C. voltage levels. The circuit of FIG. 5 includes a charge pump 36 and an LDO 38 that has two, in this example, voltage settings (e.g. 2.4 and 4.0 volts). The two voltage settings allow for separate operating voltage ranges for the resistive switch string 30' and the microphone 74 D.C. bias level. In the case where the microphone 74 is an electret microphone, the microphone's JFET preamp current (e.g. 100-500 uA) can be used to set the D.C. operating point of the LDO 38. The charge pump is used to boost the voltage level high enough to use an accurate voltage detector 76, e.g. the aforementioned MAX6376XR26 from Maxim Integrated Products.

It should be noted that in the example embodiment of circuit 34 of FIG. 5 that there are two pull-up resistors, $R_{BIAS}$ (for the JFET preamp of the microphone) and $R_{Pullup}$, which is a higher value than $R_{BIAS}$, which is used to detect the different resistor values on the switch string.

Figure 7B:
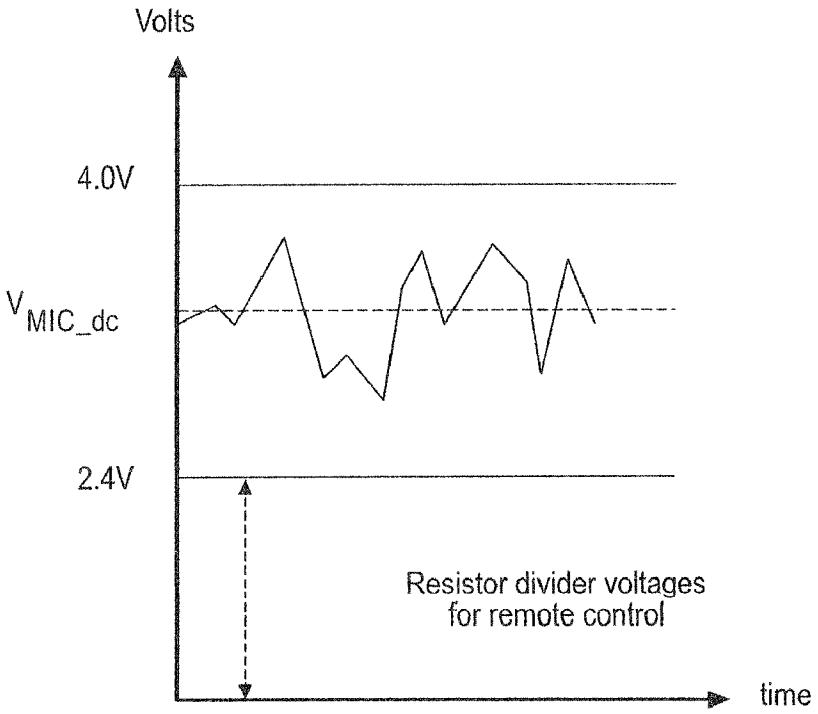
FIGS. 7A and 7B are graphs illustrating example operation for the circuitry of FIG. 6.
Figure 7A:
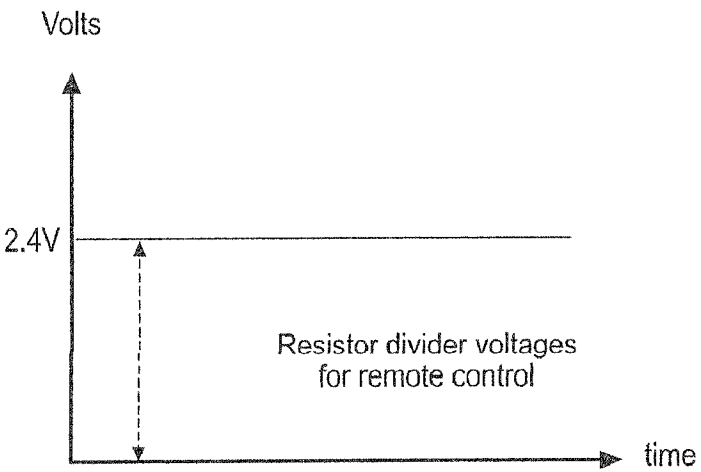

In a normal or "standby" position where the microphone is not being used, the circuitry 34 is simply monitoring for an input from the resistive switch string 30'. In the standby mode, the voltage is set to, in this embodiment, 2.4V and the $R_{BIAS}$ resistor is not in the circuit because switch 54 is open. In the headset circuit of FIG. 6, the line 32 is connected to the line 56 of circuit 34 to provide Vcc. As long as Vcc is less than 2.6 volts, in this example, the microphone 74 is disconnected from the circuit because the voltage drop across the voltage detector 76 is too low for operation. Therefore, in the standby mode, the circuit 28' of FIG. 6 operates essentially the same way as the circuit 24 of prior art FIG. 3. That is, a button press of the resistive switch string 30' serves a similar function as a button press of the switch string 26 to provide different voltage levels which can be detected by, for example, the ADC 40 of FIG. 5. More specifically, a button 84 press of resistive switch string 30' will provide voltage levels between 0 and 2.4V, as seen in FIG. 7A, which are digitized by the ADC 40 to indicate which button is being pressed.

When the electronic device signals that the microphone 74 is to become operative (i.e. leaving the standby state), it sets the voltage level of the LDO 38 to, in this example, 4.0 volts and connects the $R_{BIAS}$ resistor into the circuit by closing switch 54. This will cause Vcc on voltage detector 76 to go higher than 2.6 V, thereby causing the output of the voltage detector 76 to go to ground, activating the microphone 74. This will cause the voltage to fluctuate around a voltage $V_{MIC_dc}$ (the D.C. bias voltage) which is between 2.4V and 4.0V as seen in FIG. 7B. The JFET, in the example electret microphone 74, is a true current sink, not a resistor, so as long as the bias pullup is the same the $V_{MIC_dc}$ is shifted upwardly. As long as the A.C. voltage imposed on the $V_{MIC_dc}$ voltage is small enough so as not to drive the voltage into the resistor divider voltage range, the microphone signal will not trip the threshold detectors of the ADC 40 of FIG. 5 and a false "button press" will not be detected by the ADC.

For example, if the circuit 34 is provided in a cell phone, a user can be listening to an MP3 playing on the cell phone and can use the buttons 84 to control the play of the MP3 file. If the cell phone detects an incoming telephone call, it switches the circuit 34 of FIG. 5 into a telephone call mode by increasing the voltage on the LDO 38 to 4.0 volts to activate the microphone 74 of FIG. 5 and connecting $R_{BIAS}$ 50 by closing switch 54. The switch string 30' is still active but, presumably, a user would no longer be pressing the buttons since the music has stopped playing and they are speaking to someone on the cell phone.

While the preceding example embodiment is very useful, in some instances the pressing of a button on a remote control keypad when the headset is in a microphone-active mode can be problematical. For, when more than one of a plurality of signal sources (e.g. the microphone 74 and the resistive switch string 30' of FIG. 6) is simultaneously active, they can interact with each other in a fashion which causes erroneous operation of the combined circuit.

Figure 8:
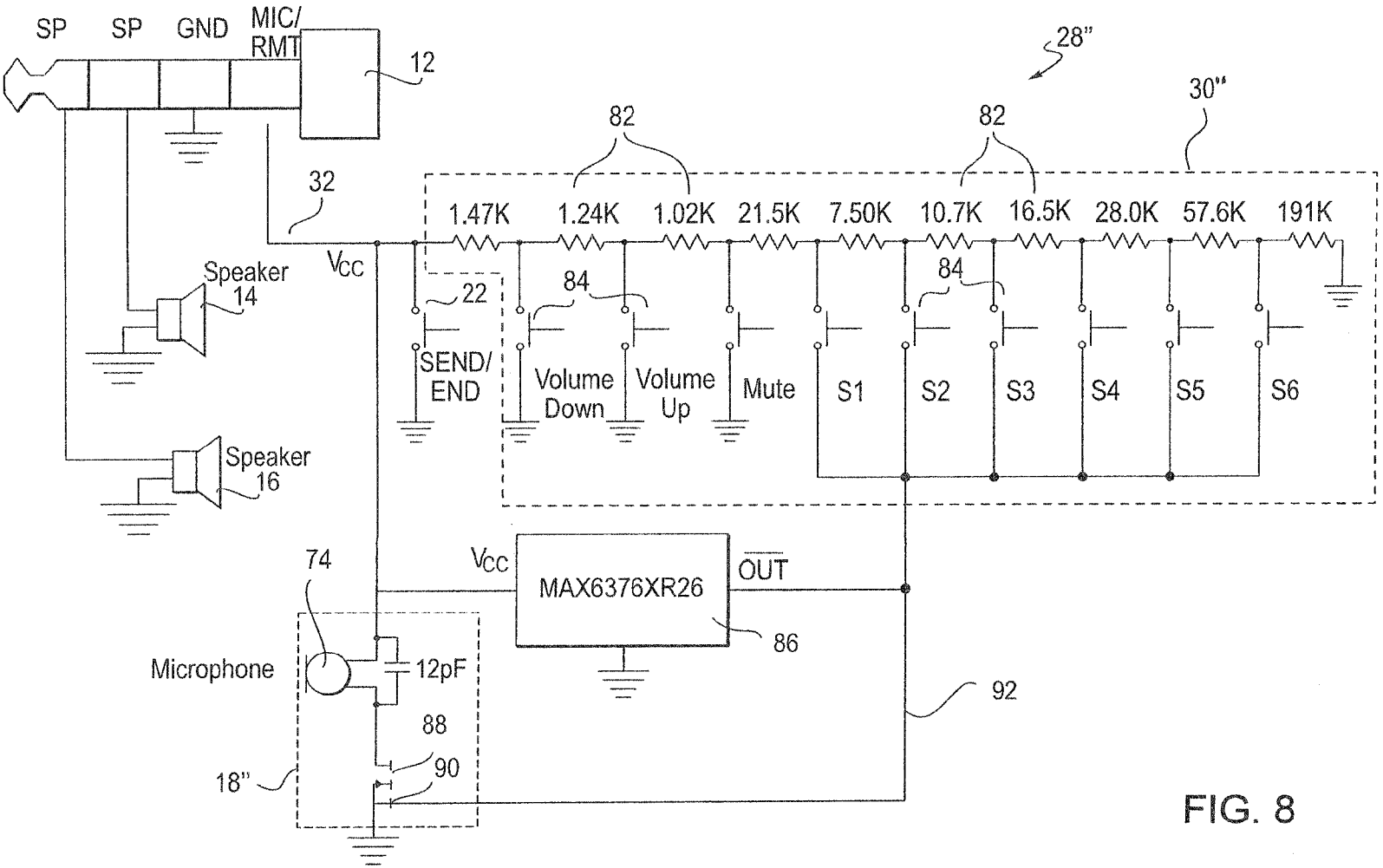
FIG. 8 is a schematic diagram of a third example embodiment of a headset with microphone, send/end button and wired remote control

An embodiment for a headset 28" of FIG. 8, set forth by way of example and not limitation, is similar to the embodiment of FIG. 6, except at least a portion of a resistive switch string 30" can be selectively enabled and disabled, the active microphone circuit 18" is modified, and a voltage detector 86 is used to selectively enable and disable both the resistive switch string 30" and the microphone circuit 18". Other than that, the components and operation of the headset 28" are analogous to the components and operation of the headset 28' of FIG. 6, with like components being given like reference numbers.

In FIG. 8, the microphone circuit 18" includes a solid state switch 88 (such as a FET) having a control input 90 coupled to a control line 92. The solid state switch selectively enables the microphone 74 by coupling it to ground. A capacitor 82 is coupled across the microphone 74 to bypass high frequency transients.

In this example, buttons 84 labeled S1-S6 are coupled to control line 92 rather than to ground, in contrast to buttons 84 labeled SEND/END, Volume Down, Volume Up, and Mute. Those buttons 84 that are coupled to control line 92 can be enabled by pulling control line 92 to LO or ground or "0" state and disabled by bringing the control line 92 to a HI or Vcc or "1" state. Of course, in other embodiments more, less, none or all of buttons 84 can be coupled to the control line 92. If all of the buttons 84 are coupled to the control line 92, the resistive switch string 30" can be completely disabled during, for example, times that the microphone 74 is active, and vice versa.

Voltage detector 86, in this example embodiment, may be a MAX6375XR26 voltage detector available from Maxim Integrated Products of Sunnyvale, Calif. An input of the voltage detector 86 is coupled to Vcc, and an output signal $\overline{OUT}$ is coupled to control line 92. It should be noted that the $\overline{OUT}$ signal is inverted such that a LO (or "0" or ground) output from voltage detector 86 activates the buttons S1-S6 of resistive switch string 30" and also "opens" the solid state switch 80 to deactivate the microphone 74. Conversely, a HI (or "1" or Vcc) $\overline{OUT}$ signal will deactivate buttons S1-S6 of resistive switch string 30" and "close" the solid state switch 80 to activate the microphone. In this fashion, the microphone and the keypad signals will not interfere with each other by simultaneously imposing signals on the common line 32. However, the headphone 28" uses two active elements (i.e. the FET 88 and the voltage detector 86) as opposed to the one active element (i.e. the voltage detector 76) of headphone 28' of FIG. 6.

Figure 9:
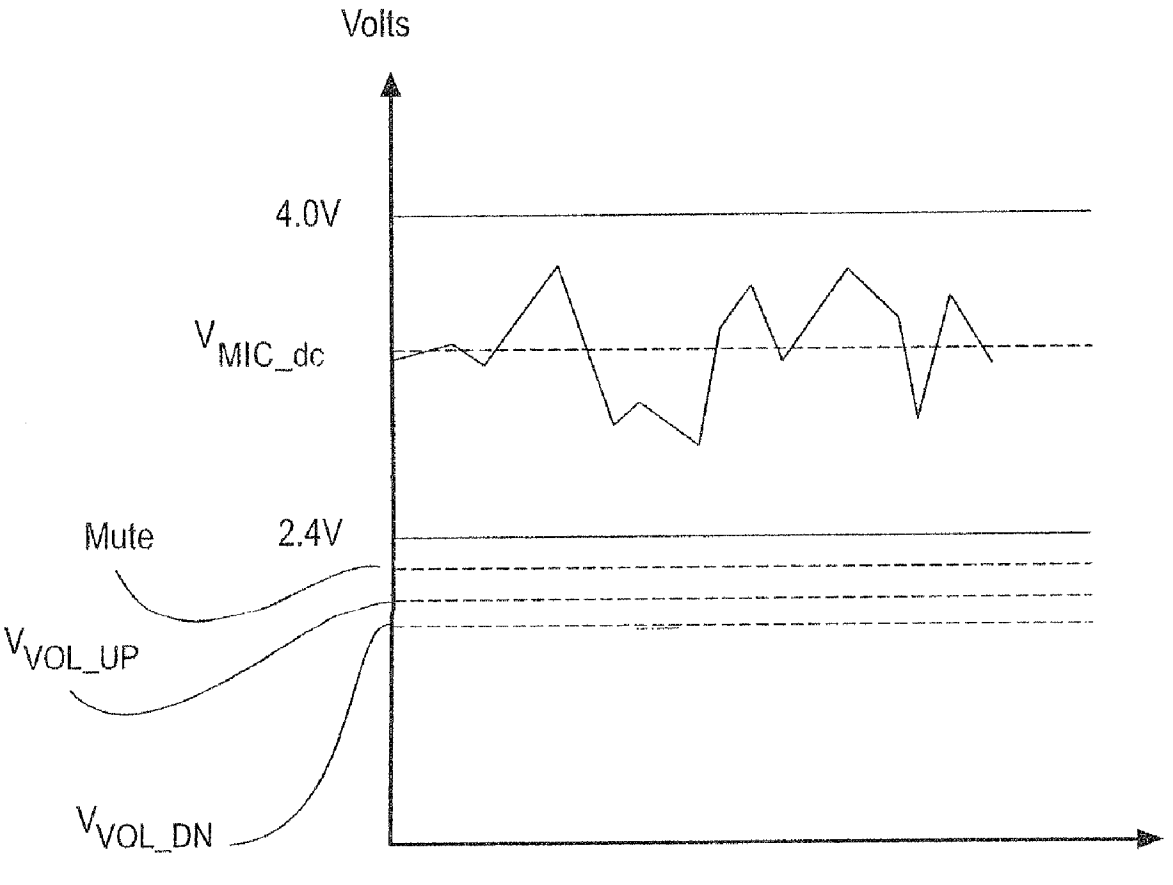
FIG. 9 is a graph illustrating example operation for the circuitry of FIG. 8.

With reference to both FIGS. 8 and 9, the headset 28" enables voltage division multiplexing of two or more signals (e.g. the signals from microphone circuit 74 and resistive switch string 30") without mutual interference. That is, only one of the microphone and the keypad are active at a given time. The microphone circuit 18" operates with a D.C. bias of $V_{MIC_dc}$ that is between 2.4 V and 4.0 V and the resistive switch string 30" operates below 2.4V.

As seen in FIG. 9, each of the buttons 84 of resistive switch string 30" creates a different voltage level, which can be detected with an ADC, such as the ADC 40 of FIG. 5. The voltage detector 86 detects the voltage level of Vcc to determine whether the headset 28" is to operate in a microphone (higher Vcc) mode or a wired remote (lower Vcc) mode.

Figure 10:
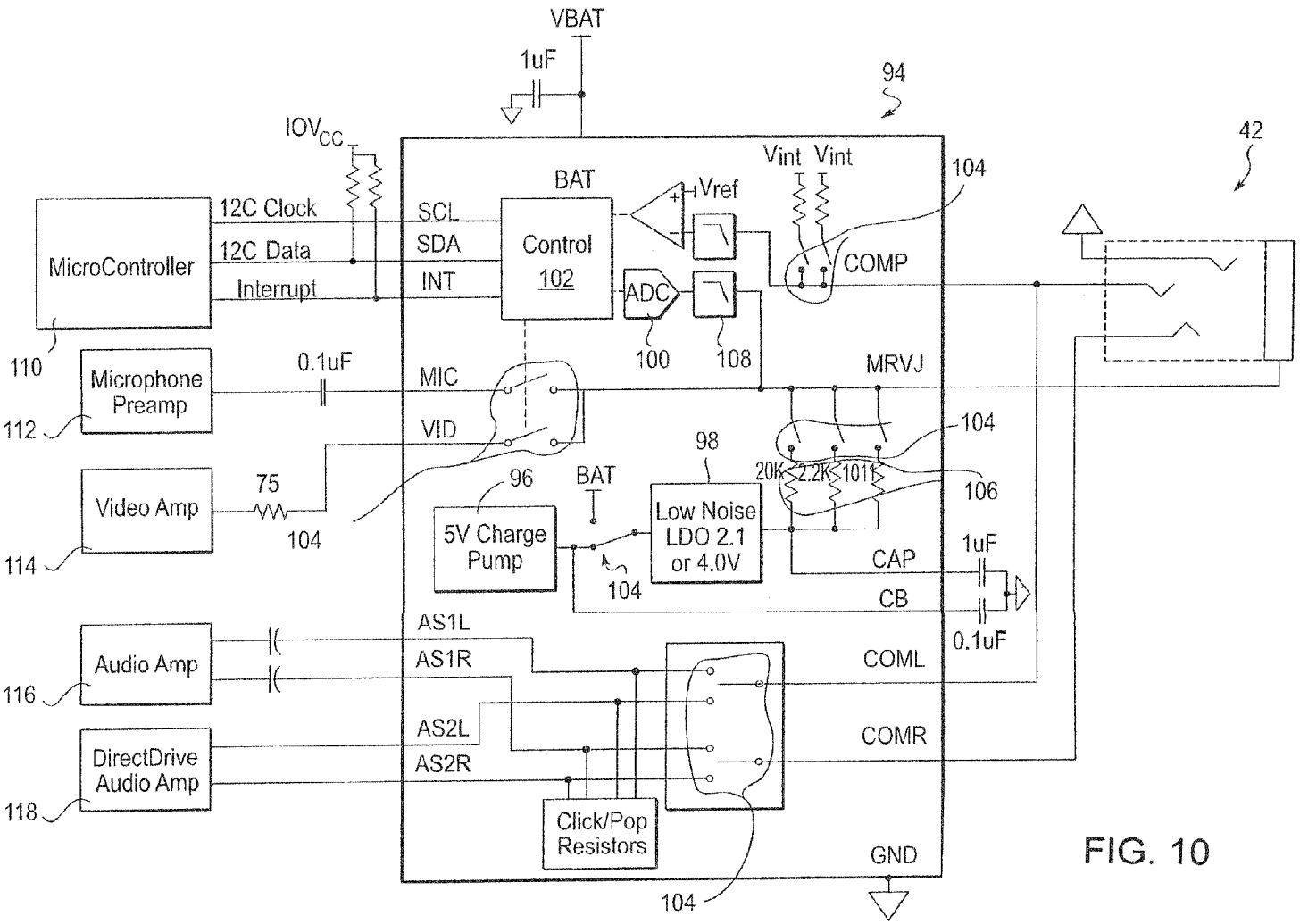
FIG. 10 is a schematic/block diagram of a second example circuitry useful with the example headsets of FIGS. 4, 5 and 8.

FIG. 10 is an example integrated circuit device 94 which can be used in an electronic device to work with a headset. It should be noted that the integrated circuit device 94 will work with any headset, i.e. it is backwardly compatible with prior art headsets such as those depicted in FIGS. 1-3 and others in addition to being forwardly compatible with the embodiments, by way of example and not limitation, depicted in FIGS. 6 and 8.

Integrated circuit device 94 includes a charge pump 96, an LDO 98 and an ADC 100 which operate analogously to the embodiment previously described with reference to FIG. 5. In addition, this embodiment includes a digital controller 102 and a number of switches 104 which are controlled by digital controller 102. As will be appreciated by those skilled in the art, the switches 104 allow the integrated circuit device to operate in a number of programmable modes.

In the embodiment of FIG. 10, a number of pull-up and/or bias resistors 106 couple the output of the LDO to a line MRVJ. A low pass filter 108 couples an input of the ADC 100 to the line MRVJ. A DPST switch 104 permits the input of the LDO to be coupled to either BAT (e.g. battery power) or the charge pump 96. In this way the LDO 98 can provide multiple voltages for voltage level multiplexing.

The charge pump 96, LDO 98 and ADC 100 operate substantially the same way as described previously with respect to FIG. 5. Additional functionality of the example embodiment integrated circuit 94 supports a number of peripheral devices. By way of example and not limitation, a number of peripheral devices such as a microcontroller 110, microphone preamp 112, voice amp 114, audio amp 116, DirectDrive® audio amp 118, and phone jack 42 may be coupled to integrated circuit device 94 as indicated. Integrated circuit device 94 may be battery powered (VBAT), and be provided with external capacitors for the charge pump 96 and LDO 98. Overall control of the integrated circuit 94 may be by microcontroller 110, which causes digital controller 102 to operate the various switches 104 to change operating modes and to provide a buffer for the ADC 100.

Although various embodiments have been described using specific terms and devices, such description is for illustrative purposes only. The words used are words of description rather than of limitation. It is to be understood that changes and variations may be made by those of ordinary skill in the art without departing from the spirit or the scope of the present invention, which is set forth in the following claims. In addition, it should be understood that aspects of various other embodiments may be interchanged either in whole or in part. It is therefore intended that the claims be interpreted in accordance with the true spirit and scope of the invention without limitation or estoppel.

What is claimed is:

1. An electronic circuit comprising:

a charge pump;

a dual-voltage LDO having an input coupled to an output of said charge pump and provided with a control input;

an ADC;

a pull-up resistor coupled between an output of said LDO and an input of said ADC;

a capacitor coupling said output of said LDO to ground;

a series connection of a bias resistor and a switch coupled between said output of said LDO and said input of said ADC in parallel to said pull-up resistor; and a microphone preamp input node coupled to said input of said ADC by a series connection of a capacitor and a switch.

2. The electronic circuit as recited in claim 1 further comprising a pair of audio output nodes.

3. The electronic circuit as recited in claim 2 further comprising a jack including a ring and a plurality of contacts.

4. The electronic circuit as recited in claim 3 wherein said ring is coupled to said input of said ADC and wherein said plurality of contacts include a pair of contacts coupled to said pair of audio output nodes and a ground contact coupled to ground.

5. The electronic circuit as recited in claim 4 further comprising a voltage level switch selectively coupling said input of said LDO to said output of said charge pump and to a power supply.

* * * * *